United States Patent [19]

Volland et al.

[11] Patent Number: 4,936,353

[45] Date of Patent: Jun. 26, 1990

[54] WEFT CATCHING ASPIRATOR WITH MECHANICAL BRAKE

[75] Inventors: Michel Volland; Gilles Grandvallet, both of Bourgoin Jallieu; Jean-Pierre Valero, Oullins, all of France

[73] Assignee: S. A. Saurer Diederichs, Bourgoin Jallieu, France

[21] Appl. No.: 349,626

[22] Filed: May 10, 1989

[30] Foreign Application Priority Data

May 10, 1988 [FR] France ..... 88 06605
Jul. 19, 1988 [FR] France ..... 88 10082

[51] Int. Cl.[5] ..... D03D 47/30
[52] U.S. Cl. ..... 139/194; 139/435.6
[58] Field of Search ..... 139/435, 429, 450, 194

[56] References Cited

U.S. PATENT DOCUMENTS 4,404,996 9/1983 Manders ..... 139/194
4,473,096 9/1984 Brouwer et al. ..... 139/194

FOREIGN PATENT DOCUMENTS 44417 10/1984 Japan ..... 139/194

*Primary Examiner*—Andrew M. Falik
*Attorney, Agent, or Firm*—Herbert Dubno; Andrew Wilford

[57] ABSTRACT

In a shuttleless loom a weft filament is inserted pneumatically in a weft direction through a warp shed by a nozzle on one side of the shed and is caught by a pneumatic aspirator aligned in the direction on the other side of the shed from the nozzle. A mechanical brake aligned in the direction on the other side of the loom with the aspirator, either immediately upstream or downstream therefrom, mechanically engages and holds the yarn after same has been caught by the aspirator. This brake can be formed by a tube with an internal brake element defining a nonstraight passage or can be a pinch brake to one side of a guide arrangement that pushes the filament laterally into the pinch brake once the filament is all the way through the aspirator and some tension is applied upstream in the filament.

19 Claims, 4 Drawing Sheets

50
46
48
43
8
45
13
17
16
20
19
VI
VI
49
44
18
30
32
9
47

13
17
16
19
20
43
44
18
30
V
V
32
49
A
1

WEFT CATCHING ASPIRATOR WITH MECHANICAL BRAKE

FIELD OF THE INVENTION

The present invention relates to a loom wherein the weft is inserted pneumatically, that is without the use of a shuttle. More particularly this invention concerns a weft-yarn aspirator and holder for such a loom.

BACKGROUND OF THE INVENTION

In a standard shuttleless loom a weft yarn is pulled from a supply spool by a mechanical feeder and fed through a fixed-resistance mechanical brake to a nozzle that is directed crosswise through a shed formed between upper and lower sheds of warp yarns. Inside the shed the yarn is guided along a passage formed by the teeth of a confining comb mounted on a support along with the beating comb. The yarn is moved the entire weft-wise width of the fabric by relay nozzles spaced along the shed and pressurized sequentially. At the downstream edge of the goods the yarn is trapped by a weft-yarn aspirator and held thereby. Such an arrangement is described in French patents Nos. 2,184,052, 2,448,293, and 2,526,053.

The aspirator operates pneumatically like the relay nozzles and insertion nozzle and sucks in the weft filament. It normally is formed by a tube aligned with the insertion nozzle and equipped with an internal air jet directed away from the insertion nozzle so that by venturi or jet-pump effect it creates suction at the intake end of the tube. The downstream flow of air away from the insertion nozzle not only pulls in the weft filament but maintains it under some tension once it is aspirated. The function of this holder, whose intake jet is pressurized sequentially after the last of the relay nozzles to economize compressed gas, is to position and then maintain some tension in the weft yarn during beating in. Unfortunately this system not only is quite wasteful of compressed gas but also is often not able to maintain enough tension in the weft yarn. What is more it relies on the relay nozzles for the holding effect so that gas is wasted in this manner also.

OBJECTS OF THE INVENTION

It is therefore an object of the present invention to provide an improved weft holder or catcher for a loom with pneumatic weft-yarn insertion.

A further object is the provision of such a weft catcher which securely holds the weft yarn and that uses only a modest amount of air to do so.

SUMMARY OF THE INVENTION

The instant invention is used in a shuttleless loom wherein a weft filament is inserted pneumatically in a weft direction through a warp shed by a nozzle on one side of the shed and is caught by a pneumatic aspirator aligned in the direction on the other side of the shed from the nozzle. The invention is a mechanical brake aligned in the direction on the other side of the loom with the aspirator, either immediately upstream or downstream therefrom, for mechanically engaging and holding the yarn after same has been caught by the aspirator.

Thus according to this invention when some tension is applied to the filament upstream of the brake and aspirator, the filament that is lightly held by the aspirator will engage the brake element and be trapped or caught mechanically thereby, greatly increasing the amount of tension in the yarn. This ensures accurate weaving.

According to this invention the brake includes a tube having an intake end open in the direction toward the nozzle and an output end open in the direction away from the nozzle, and at least one braking element in the tube defining therein a nonstraight path extending between the tube ends. The path defined by the element is of increasing flow cross section from the intake end to the output end. Thus the weft filament will be sucked in and surely fed along the path, whether the brake is at the upstream or downstream end of the aspirator.

In accordance with further features of this invention the tube is of generally uniform cross section and is provided internally with a plurality of spaced vanes constituting braking elements and each blocking most but not all of the cross section of the tube, whereby the path is a meander. The tube has opposite sides and the vanes extend therefrom, alternating along the path from one of the sides to the other side. In fact the vanes extend generally perpendicular to the tube although it is possible for them to extend at acute angles to the tube. These vanes can be spaced along the tube at spacings increasing from the intake end to the output end so that the flow cross-section of the path increases downstream or the vanes can be of increasing transverse dimension from the intake end to the output end so that the flow cross-section of the path increases downstream.

In another arrangement according to this invention the braking element is formed with a helicoidal ridge so that the path is a helicoid. The tube ends can be aligned in the direction and the ridge of the element can be substantially centered on a line corresponding to the direction. The braking element is shaped such that the flow cross section of the path increases from the intake end to the output end. It is also possible for the tube ends to be offset transversely relative to the direction with the intake end directly aligned in the direction with the nozzle so that the ridge is centered on a line generally perpendicular to the direction and the intake and output ends open tangentially of the line.

It is further possible in accordance with this invention for the mechanical brake to include a pair of pinch elements adjacent the aspirator, a spring for biasing the pinch elements toward each other, and a guide for urging the filament laterally between the pinch elements after the filament is caught by the aspirator. This guide can be a nonstraight or S-shaped guide tube having an upstream end open in the direction and a downstream end offset laterally to one side in the direction from the upstream end. The pinch elements are positioned to the one side of the upstream end.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

Specific Description

Figure 1:
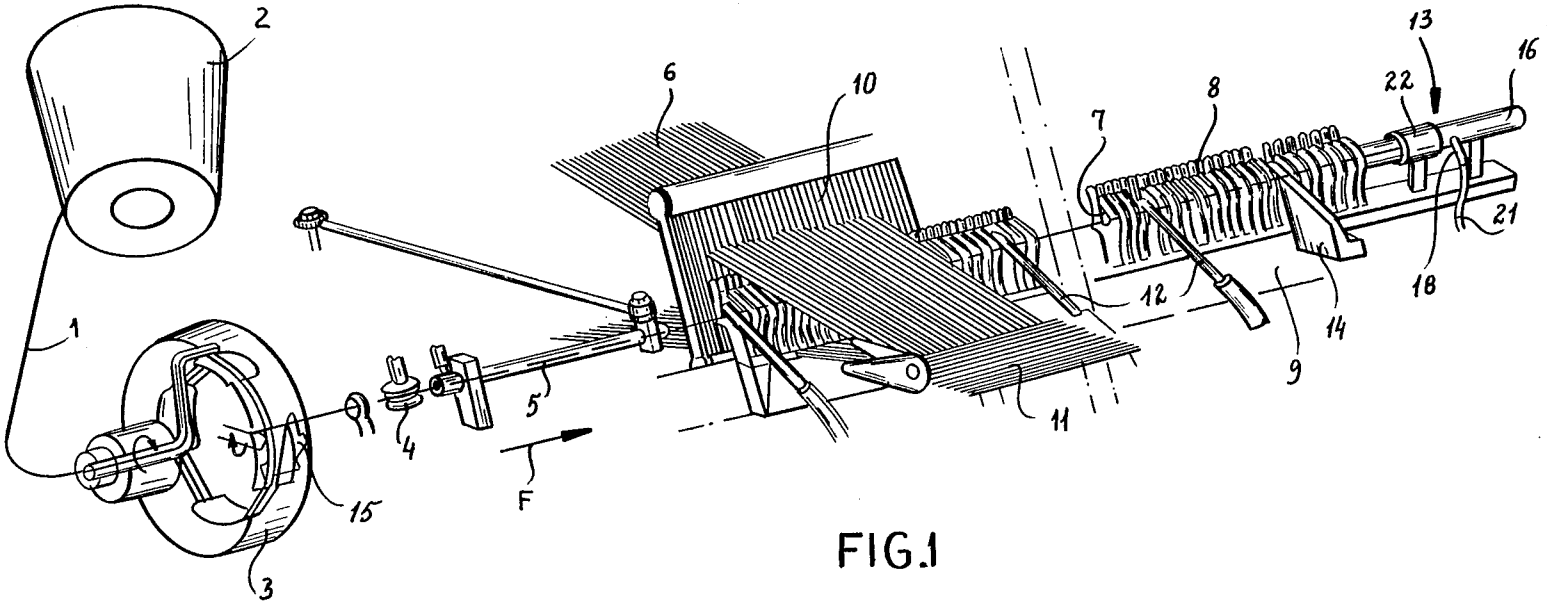
FIG. 1 is a largely diagrammatic perspective view of a loom according to this invention.

As seen in FIG. 1 a loom according to this invention has a weft yarn 1 that is pulled from a supply spool 2 by a rotary mechanical feeder 3 and fed as a pick through a fixed-resistance mechanical brake 4 to a nozzle 5 that is directed crosswise through a shed formed between upper and lower sheds of warp yarns 6. Inside the shed the yarn 1 is guided along a passage 7 formed by the teeth of a confining comb or guide element 8 mounted on a sley 9 along with a reed 10. The yarn 1 is moved the entire weft-wise width of the fabric 11 by relay nozzles 12 spaced along the shed and pressurized sequentially in the manner known per se.

At the downstream edge of the goods 11 the yarn 1 is trapped by a weft-yarn aspirator/holder 13. An optoelectric detector 14 in the shed can detect the presence or absence of the yarn 1 to control, among other things, the operation of the holder 13 and to shut down the loom if no weft yarn is fed. This detector 14 is carried on the sley 9 as the elements 8 and 10. Scissors 15 at the upstream side of the shed serve to cut off the length of weft once it is beaten in.

Figure 2:
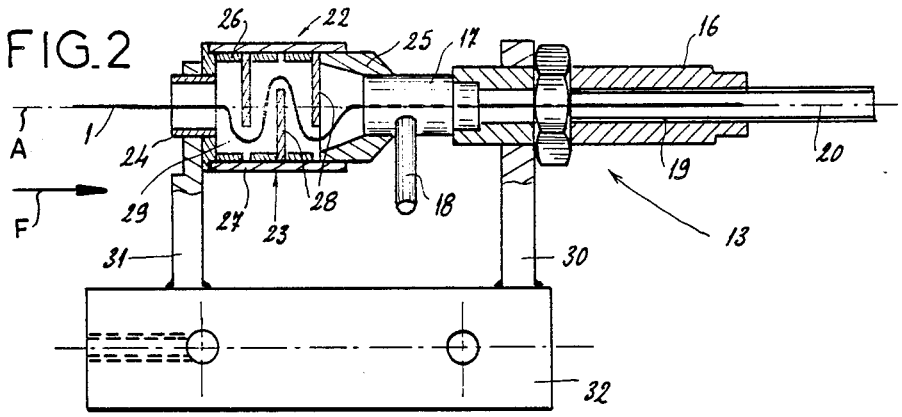
FIG. 2 is an axial section through a first species of a weft-thread aspirator/holder according to the invention.

All of the holders 13 according to this invention and as seen in some detail in FIG. 2 comprise an aspirator 16 provided with an intake-end fitting 17 connected at 18 to a supply of gas under pressure and extended as a tube 19 centered on an axis 20 coinciding with or parallel to the line or axis A along which the weft yarn 1 is shot by the nozzle 1 through the shed. These parts 17–20 can be constructed to work venturi-fashion as described in above-mentioned French patent No. 2,526,053. FIG. 1 shows a pressure line 21 secured to the connection 18. The blast of air is generally axially downstream relative to the direction F of displacement of the yarn 1 from the nozzle 5 across the fabric 11.

In the first system shown in FIG. 2 the upstream end of the intake fitting 17 of the conventional weft-yarn aspirator is provided with a mechanical brake 22 constituted by a square-section tube 23 of relatively large diameter centered on the axes A and 20 and provided at its upstream end with a small-diameter intake tube 24 centered on these axes and at its downstream end with a frustoconical coupling 25 fitted to the tube 17. The tube 23 has an upper wall 26 and a lower wall 27 formed with transverse slots into which are fitted vanes or partitions 28 that extend perpendicular to the axes A and 20. These partitions 28 are the full width between the vertical side walls of the tube 23 but have heights which are equal to substantially more than half but not all of the internal height of the tube 23. In addition the partitions 28 are alternated up and down in the upper and lower walls 26 and 27 so that they define a vertically meandering passage 29 for the filament 1. In addition the heights of the vanes 28 increase in the downstream (left to right in FIG. 2) direction so that the flow cross section of this passage 29 decreases downstream. The entire assembly of tube 23, fitting 17, and tube 16 is carried via two legs 30 and 31 on a mount 32 fixed to the sley 9 that also carries the guide element 8 and reed 10.

Thus the downstream flow of air caused by the venturi effect in the fitting 17 will cause the filament 1 to be aspirated into the upstream end of the tube 24. Thereafter the yarn 1 will follow the zig-zag path 29 through the brake 22. Contact of the yarn 1 with the edges of the partitions 28 will have a mechanical braking action that will hold the yarn 1 quite tight during beating in of the shed. The zigzag or meander shape of the path 29 ensures that the yarn 1 is engaged on opposite sides by mechanical elements so that any tension in the yarn 1 will naturally increase the braking action.

Figure 3:
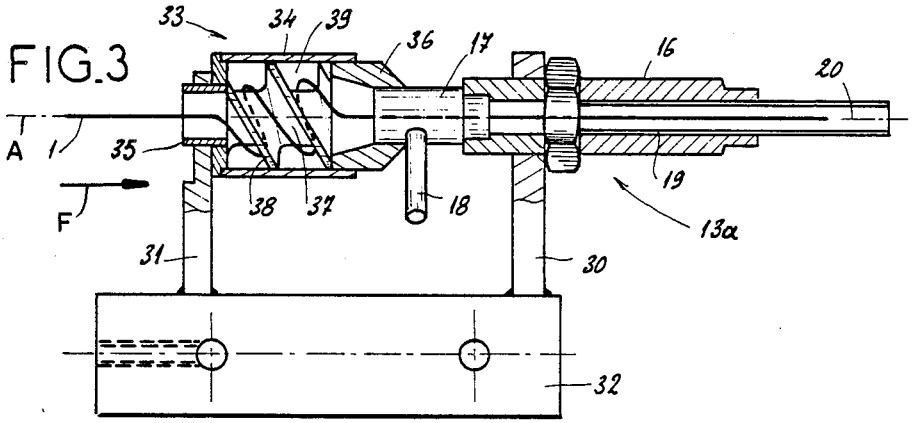
FIG. 3 is an axial section through a second species of the aspirator/holder.

FIG. 3 shows a system where the upstream end of the intake fitting 17 of the conventional weft-yarn aspirator is provided with a mechanical brake 33 constituted by a circular-section tube 34 of relatively large diameter centered on the axes A and 20 and provided at its upstream end with a small-diameter intake tube 35 that is slightly offcenter to these axes and on its downstream end is fitted with a frustoconical coupling 36 to the tube 17. The tube 34 is provided internally with an auger-like element 37 having a helical ridge 38 defining a helical passage 39 opening at its upstream end at the intake tube 35 and at its downstream end into the fitting 36.

The downstream flow of air caused by the venturi effect in the fitting 17 will cause the filament 1 to be aspirated into the upstream end of the tube 35. Thereafter the yarn 1 will follow the helical path 39 through the brake 33. Contact of the yarn 1 with the edges of the element 37 will have a mechanical braking action that will hold the yarn 1 quite tight during beating in of the shed. The diameter of the core of the element 37 can decrease and/or the pitch of its ridge 38 can increase to increase the size of the passage 39 in the downstream direction.

Figure 4:
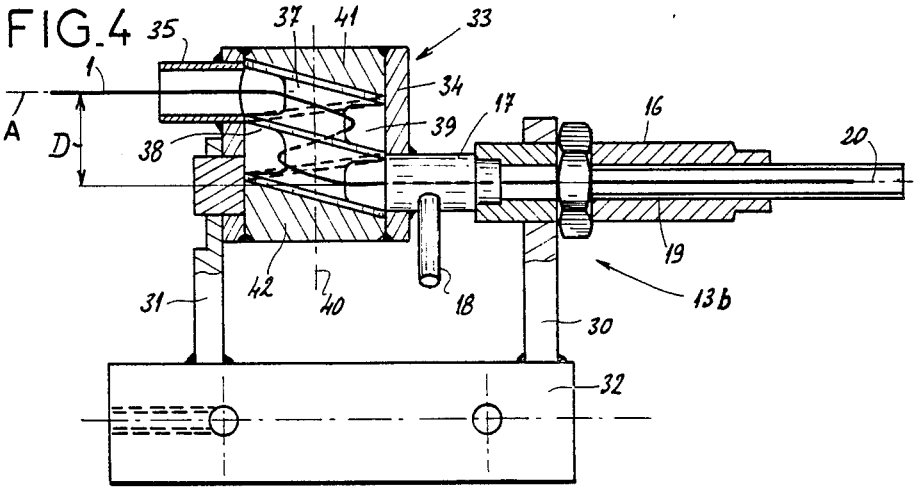
FIG. 4 is an axial section through a third species of the aspirator/holder.

In FIG. 4 the system is similar to that of FIG. 3 except that the axes A and 20 are offset by a distance D and the helix element 37 and the tube 34 are centered on an axis 40 perpendicular to and intersecting these axes A and 20. The ends of the tube 34 ar closed by plugs 41 and 42 and the tubes 35 and 17 both enter tangentially of the axis 40. Thus in use the filament 1 wraps around the core of the element 37 for the desired braking effect.

Figure 5:
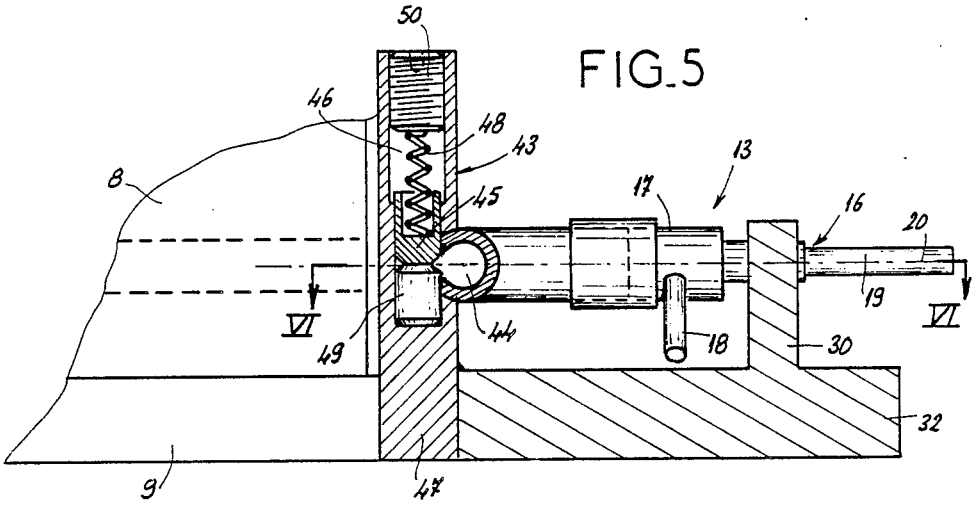
FIG. 5 is an axial section through a fourth species of the aspirator/holder.
Figure 6:
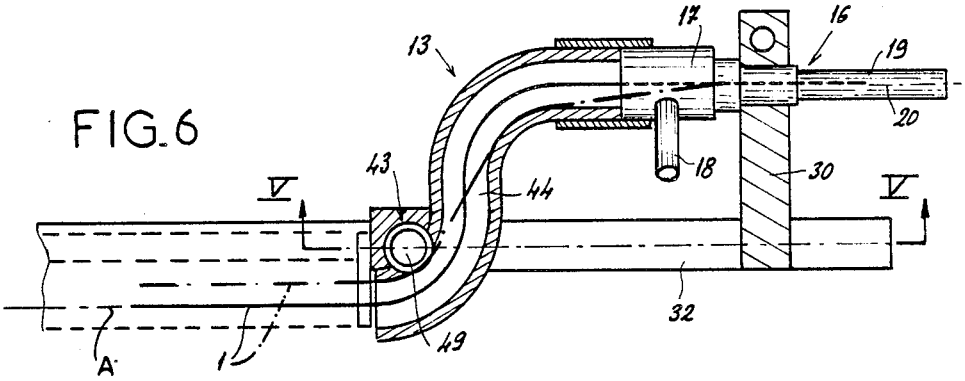
FIG. 6 is a section taken along line VI—VI of FIG. 5, line V—V of FIG. 6 indicating the section plane of FIG. 5.

In the arrangement of FIGS. 5 and 6 a mechanical pincher brake 43 is provided at the upstream end of an S-shaped tube 44 whose upstream end is centered on the axis A and whose downstream end is centered on the axis 20 and joined to the fitting 17, the axes A and 20 being offset. This brake 43 is located between the axes A and 20 and comprises a lower anvil 49 against which a piston 45 is pressed by a spring 48 bearing in a tube 46 against a plug 50. The nip between the elements 45 and 49 is positioned such that once the yarn 1 is pulled as shown by the solid line through the unit 13 and gets tight, it will assume the position shown by the dot-dash line and be pinched between the elements 45 and 46. The holding action is considerable and allows the air supply to the fitting 18 to be cut off as soon as the yarn 1 is caught. Of course, other types of pincher brakes could be used. Once the yarn 1 is beaten in, it can be pulled out of the brake 43.

Figure 7:
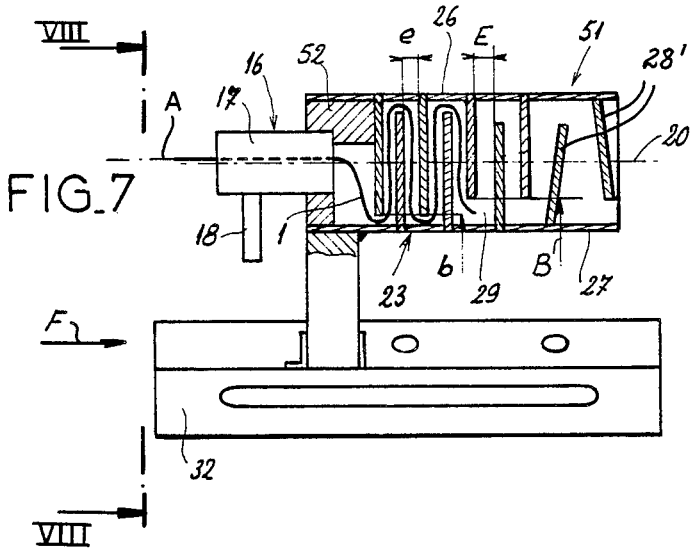
FIG. 7 is an axial section through a sixth species of the weft-yarn aspirator/holder according to the invention.
Figure 8:
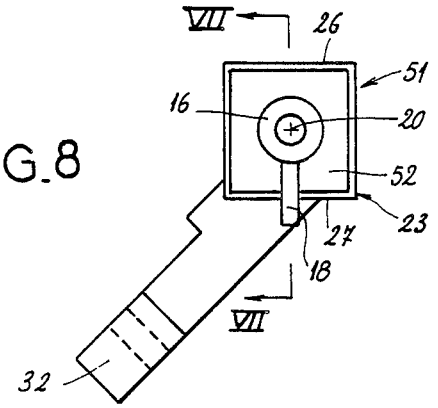
FIG. 8 is a section taken along line VIII—VIII of FIG. 7, line VII—VII of FIG. 8 indicating the section plane of FIG. 7.

In FIGS. 7 and 8 a brake 51 is provided which is constructed much like that of FIG. 3, except that it is provided downstream of the fitting 17, that is at its outlet. Here, however, the passage 29 is of increasing cross section, an effect achieved by increasing the spacing e between adjacent partitions 28 in the direction F of travel and also increasing the spacing b between the edges of the vanes 28 and the walls 26 and 27 of the square-section housing 23. The number of vanes and the section of the tube can, of course, be changed without leaving the scope of this embodiment of the invention. In addition it is possible to angle vanes 28' to the axis 20 to increase the braking effect.

We claim:

1. In a shuttleless loom wherein a weft thread is inserted pneumatically in a weft direction through a warp shed by a nozzle on one side of the shed and is caught by a pneumatic aspirator aligned in the weft direction on the other side of the shed from the nozzle, the improvement comprising:

mechanical brake means aligned in the weft direction on the other side of the shed with the aspirator and including a tube having an intake end open in the weft direction toward the nozzle and an output end open in the weft direction away from the nozzle, and at least one braking element in the tube defining therein a nonstraight path extending between the tube ends for mechanically engaging and holding the thread after same has been caught by the aspirator.

2. The improved shuttleless loom defined in claim 1 wherein the path defined by the element is of increasing flow cross section from the intake end to the output end.

3. The improved shuttleless loom defined in claim 1 wherein the tube is of generally uniform cross section and is provided internally with a plurality of spaced vanes constituting the braking element and each blocking most but not all of the cross section of the tube, whereby the path is a meander.

4. The improved shuttleless loom defined in claim 3 wherein the tube has opposite sides and the vanes extend therefrom, alternating along the path from one of the sides to the other side.

5. The improved shuttleless loom defined in claim 4 wherein the vanes extend generally perpendicular to the tube.

6. The improved shuttleless loom defined in claim 4 wherein the vanes extend at acute angles to the tube.

7. The improved shuttleless loom defined in claim 4 wherein the vanes are spaced along the tube at spacings increasing from the intake end to the output end, whereby the flow cross-section of the path increases downstream.

8. The improved shuttleless loom defined in claim 4 wherein the tubes are of increasing transverse dimension from the intake end to the output end, whereby the flow cross-section of the path increases downstream.

9. The improved shuttleless loom defined in claim 1 wherein the braking element is formed with a helicoidal ridge, whereby the path is a helicoid.

10. The improved shuttleless loom defined in claim 9 wherein the tube ends are aligned in the weft direction and the ridge of the element is substantially centered on a line corresponding to the weft direction.

11. The improved shuttleless loom defined in claim 10 wherein the braking element is shaped such that the flow cross section of the path increases from the intake end to the output end.

12. The improved shuttleless loom defined in claim 9 wherein the tube ends are offset transversely relative to the weft direction with the intake end directly aligned in the weft direction with the nozzle, the ridge being centered on a line generally perpendicular to the weft direction and the intake and output ends opening tangentially of the line.

13. In a shuttleless loom wherein a weft thread is inserted pneumatically in a weft direction through a warp shed by a nozzle on one side of the shed and is caught by a pneumatic aspirator aligned in the weft direction on the other side of the shed from the nozzle, the improvement comprising:

means including a mechanical brake aligned in the weft direction on the other side of the shed with the aspirator for mechanically engaging and holding the thread after same has been caught by the aspirator, the brake means lying in the weft direction between the aspirator and the nozzle and having an output end opening directly into the aspirator.

14. In a shuttleless loom wherein a weft thread is inserted pneumatically in a weft direction through a warp shed by a nozzle on one side of the shed and is caught by a pneumatic aspirator aligned in the direction on the other side of the shed from the nozzle, the improvement comprising:

means including a mechanical brake aligned in the weft direction on the other side of the shed with the aspirator for mechanically engaging and holding the thread after same has been caught by the aspirator, the brake means being downstream in the weft direction from the aspirator and having an intake end opening upstream in the weft direction into the aspirator.

15. In a shuttleless loom wherein a weft thread is inserted pneumatically in a weft direction through a warp shed by a nozzle on one side of the shed and is caught by a pneumatic aspirator aligned in the direction on the other side of the shed from the nozzle, the improvement comprising:

means including a mechanical brake aligned in the direction on the other side of the shed with the aspirator and comprising a pair of pinch elements adjacent the aspirator;

means for biasing the pinch elements toward each other; and means for urging the thread laterally between the pinch elements after the thread is caught by the aspirator for mechanically engaging and holding the thread after same has been caught by the aspirator.

16. The improved shuttleless loom defined in claim 15 wherein the means for urging is a nonstraight guide having an upstream end open in the weft direction and a downstream end offset laterally to one side in the weft direction from the upstream end, the pinch elements being positioned to the one side of the upstream end.

17. The improved shuttleless loom defined in claim 16 wherein the nonstraight guide is an S-shaped tube.

18. In a shuttleless loom wherein a weft thread is inserted pneumatically in a weft direction through a warp shed by a nozzle on one side of the shed and is caught by a pneumatic aspirator aligned in the weft direction on the other side of the shed from the nozzle, the improvement comprising:

a tube having an intake end open in the weft direction toward the nozzle and an output end open in the weft direction away from the nozzle, one of the ends being connected in the weft direction with the aspirator, and at least one braking element in the tube defining therein a nonstraight path extending between the tube ends and increasing in flow cross section from the intake end to the output end.

19. In a shuttleless loom wherein a weft thread is inserted pneumatically in a weft direction through a warp shed by a nozzle on one side of the shed and is caught by a pneumatic aspirator having upstream and downstream ends and aligned in the weft direction on the other side of the shed from the nozzle, the improvement comprising:

a pair of pinch elements;

means for biasing the pinch elements toward each other; and a nonstraight guide having an upstream end open in the weft direction and a downstream end offset laterally to one side in the weft direction from the upstream end, one of the ends being connected to one of the ends of the aspirator, the pinch elements being positioned to the one side of the upstream end.

* * * * *